United States Patent [19]

Shoji et al.

[11] Patent Number: 4,822,715

[45] Date of Patent: Apr. 18, 1989

[54] ALUMINUM ALLOY SUPPORTER FOR LITHOGRAPHIC PRINTING PLATE

[75] Inventors: Ryo Shoji; Chozo Fujikura, both of Tochigi; Kazushige Takizawa; Hirokazu Sakaki, both of Shizuoka, all of Japan

[73] Assignees: Furukawa Aluminum Co., Ltd., Tokyo; Fuji Photo Film Co., Ltd., Minamiashigara, both of Japan

[21] Appl. No.: 31,269

[22] Filed: Mar. 30, 1987

[30] Foreign Application Priority Data

Apr. 1, 1986 [JP] Japan ..... 61-75239

[51] Int. Cl.[4] ..... G03C 1/94

[52] U.S. Cl. ..... 430/155; 430/157; 430/165; 430/167; 430/278; 430/302

[58] Field of Search ..... 430/278, 157, 166, 167, 430/165, 155, 302

[56] References Cited

U.S. PATENT DOCUMENTS

| | | | |
|---|---|---|---|
| 4,476,006 | 10/1984 | Ohba et al. | 430/155 |
| 4,672,022 | 6/1987 | Reiss et al. | 430/278 |
| 4,729,939 | 3/1988 | Nishikawa et al. | 430/165 |

FOREIGN PATENT DOCUMENTS

| | | | |
|---|---|---|---|
| 0274993 | 12/1986 | Japan | 430/278 |

*Primary Examiner*—Charles L. Bowers, Jr.
*Attorney, Agent, or Firm*—Oblon, Fisher, Spivak, McClelland & Maier

[57] ABSTRACT

An aluminum alloy support for lithographic printing plate comprising 0.05 to 0.5 wt. % of Fe, 0.1 to 0.9 wt. % of Mg, 0.01 to 0.3 wt % of V and/or Ni, not more than 0.2 wt. % of Si, not more than 0.05 wt. % of Cu and the remainder of Al and inevitable impurities is disclosed. In addition, 0.01–0.3 wt. % of Zr and/or 0.05–2 wt. % of Mn may be contained.

9 Claims, No Drawings

ALUMINUM ALLOY SUPPORTER FOR LITHOGRAPHIC PRINTING PLATE

BACKGROUND OF THE INVENTION

The present invention relates to a support used for the lithographic printing plate, which is formed by providing an anodic oxide film on the roughened surface of aluminum alloy plate and further coating thereon a photosensitive material. The support for a lithographic printing plate gives an uniform rough surface by electrochemical roughening treatment and is excellent in the strength, thermal softening-resistant characteristic and printability.

Conventionally, as the lithographic printing plates, those coated with the photosensitive material onto the aluminum plate provided the surface treatments such as roughening treatment, treatment of forming anodic oxide film, etc. are used. Among these, one used most widely is so-called PS plate coated with the photo-sensitive material beforehand and ready to be printed instantaneously. To such lithographic printing plate, the platemaking treatments such as exposure to light for imaging, development, washing with water, lacquering, etc. are given to obtain the press plate. It is a well-known fact that development of an exposed plate results in an image portion which is composed of insoluble photosensitive material and a non-image portion which results from the removal of soluble photosensitive material from the exposed plate, thereby exposing the underlying aluminum surface. The exposed aluminum layer, i.e., the non-image area, because it is hydrophilic, is the water attracting area.

As the supporter for such lithographic printing plate, aluminum plate which is light in weight and excellent in the surfaceprocessibility, workability and corrosion resistance is used, in general, and, as the conventional materials offered to this purpose, there are aluminum alloys with a thickness of 0.1 to 0.8 mm such as JIS 1050 (pure Al with a purity of not less than 99.5 wt. %), JIS 1100 (alloy consisting of Al—0.05 to 0.20 wt.% Cu), JIS 3003 (alloy consisting of Al—0.05 to 0.20 wt. % Cu1.5 wt. % Mn). etc. The surface of these materials is roughened by the roughening methods through the processes employed either one or not less than two of mechanical method, chemical method and electrochemical method and thereafter the anodic oxidation treatment is given preferably.

Concretely, an aluminum lithographic printing plate described in Japanese Unexamined Patent Publication No. sho 48-49501 wherein the mechanical roughening treatment, chemical etching treatment and treatment of forming anodic oxide film are given in this order, an aluminum lithographic printing plate described in Japanese Unexamined Patent Publication No. sho 51-61304 wherein the chemical etching treatment and treatment of forming anodic oxide film are given in this order, an aluminum lithographic printing plate described in Japanese Patent Publication No. sho 54-146234 wherein the electrochemical treatment, post-treatment and treatment of forming anodic oxide film are given, an aluminum lithographic printing plate described in Japanese Patent Publication No. sho 48-28123 wherein the electrochemical treatment, chemical etching treatment and treatment of forming anodic oxide film are given in this order, an aluminum lithographic printing plate described in Japanese Unexamined Patent Publication No. sho 54-63902 wherein the mechanical roughening treatment, chemical etching treatment and electrochemical roughening treatment are given in this order, and the like are known. By selecting the photosensitive layer to be coated onto such support appropriately, it is possible to obtain distinct prints amounting to even a hundred thousand sheets.

However, there is a request for obtaining more sheets of prints from a printing plate (improvement in the printing tolerance). In such case, a method is effective wherein, after the exposure to light and the development treatment of PS plate having the aluminum alloy plate as support by usual method, the heating treatment (so-called burning treatment) is made at high temperature to reinforce the image area, and this method is described in detail in Japanese Patent Publication No. sho44-27243 and sho 44-27244. Although the heating temperature and the time of such burning treatment depend upon the type of resins forming the image, a range of 200° to 280° C. and that of 3 to 7 minutes were common.

Recently, with respect to the burning treatment, higher temperature and shorter time have been desired from the reasons of the improvement in printing tolerance and shortening of time for burning treatment. However, with the aluminum alloy plates having been used conventionally, the recrystallization phenomenon of aluminum occurs when heating at a high temperature of more than 280° C., and, because of extreme lowering of the strength and loss of the stiffness of plate, the handling of plate becomes very difficult resulting in the shortcomings such that the setting of plate on the press becomes impossible, that the registering of color on plate cannot be made in multicolor printing, and the like. Therefore, the stable aluminum alloy plate rich in heat resistance is desired.

On the other hand, in these days when the printing speed has been increased accompanying with the progress in the printing technology, the stress exerted on the printing plate secured mechanically to both ends of plate cylinder in the press is increased. Consequently, when the tensile strength is deficient, these secured portions are deformed or damaged to cause the obstructions such as discrepancies in print etc. and, when the fatigue strength is deficient, the plate is broken due to the repeated stresses exerting on the folded portions of printing plate (breakdown by clamping) resulting in the impossibility in printing frequently.

With conventional aluminum alloy plate according to JIS 1050, uniform rough surface and proper surface roughness can be obtained by the electrochemical roughening treatment and the staining of nonimage area is hard to occur during printing, but the strength and the thermal softening-resistant characteristic are poor. Moreover, conventional aluminum alloy plate according to JIS 3003 has more excellent strength and thermal softening-resistant characteristics, but uniform rough surface and proper surface roughness cannot be obtained and further there is a shortcoming that the staining of nonimage area is also apt to occur during printing. Furthermore, the thermal softening resistance has also become not always to be said that it is sufficient for the severe level of request in recent years.

Accordingly, the purpose of the invention is to provide a support for lithographic printing plate which has the strength (concretely, tensile strength and fatigue strength) and the thermal softening-resistant characteristic and which enables to give uniform rough surface and proper surface roughness by the roughening treatment, in particular, electrochemical roughening treatment resulting in that the staining of the nonimage area is hard to occur during printing.

SUMMARY OF THE INVENTION

As a result of extensive studies to attain this purpose, the inventors have found that a support made from aluminum alloy comprising 0.05 to 0.5 wt. % of Fe, 0.1 to 0.9 wt. % of Mg, 0.01 to 0.3 wt. % of V and/or Ni, not more than 0.2 wt. % of Si, not more than 0.05 wt. % of Cu and the remainder of Al and the inevitable impurities or aluminum alloy comprising 0.05 to 0.5 wt. % of Fe, 0.1 to 0.09 wt. % of Mg, 0.01 to 0.3 wt. % of Zr and/or 0.05 to 2 wt.% of Mn, 0.01 to 0.3 wt. % of V and/or Ni, not more than 0.2. wt. % of Si, not more than 0.05 wt. % of Cu and the remainder of Al and the inevitable impurities can satisfy the purpose, and the invention has been completed based on this knowledge.

DETAILED DESCRIPTION OF THE INVENTION

In the invention, the reasons why the composition of support was confined as above are as follows (hereinafter, % showing the composition means wt. %).

Mg has the effects to improve the strength and thermal softening-resistant characteristic without affecting inversely on the roughening treatment of plate surface and the printability, but, if under 0.1 %, the effects are insufficient and, if over 0.9 %, the staining of nonimage area becomes apt to occur.

Fe has improvement effects in the thermal softening resistance in addition to the function to make the crystal particles and the electrolytically roughened surface uniform and fine. Fe is an element which combines with other elements in the aluminum alloy and forms eutectic compounds of the type of Al-Fe or Al-Fe-Si, and these eutectic compounds exert the effect to produce uniform and fine rough surface by electrolysis together with the effect to make the recrystallized particles fine. If the content of Fe is under 0.05 %, the effects to make the recrystallized particles fine, to make the electrolytically roughened surface uniform and fine and to improve the thermal softening-resistant characteristic are less, and, if the content exceeds 0.5 %, the electrolytically roughened surface becomes ununiform inversely due to the formation of coarse compounds.

Zr, V and Ni have an effect to improve the thermal softening-resistant characteristic remarkable and every one exerts similar effect, but, if less than 0.01 %, the effect is limited and, if over 0.3 %, the recrystallized crystals become ununiform and the uniformity of electrolytically roughened surface is also inferior. These elements may be added in combination but the total amount is necessary not to exceed 0.3 %.

In the invention, it is preferable to add Mn further to improve the thermal softening-resistant characteristic and the strength, but, if the addition amount exceeds 2 %, coarse intermetallic compounds are formed and not only the uniformity of the electrolytically roughened surface deteriorates but also the occurrence of staining of nonimage area originates making the addition unsuitable.

Si is made not more than 0.2 %. Si is contained as an usual impurity and, if over 0.2 %, the uniformity of rough surface is harmed and the staining of nonimage area is also apt to occur. In addition, since Si combines with Fe to produce the deposits of the type of Al-Fe-Si, the amount of Fe in solid solution is decreased and consequently the thermal softening-resistant characteristic deteriorates.

Cu is made not more than 0.05 %. Cu is contained as an usual impurity and, if over 0.05 %, the uniformity of rough surface is harmed and the staining of nonimage area is also apt to occur.

In the alloys used according to the invention, the inevitable impurities are Ga, Cr, Zn, etc. and, if the content thereof is not more than 0.05 %, there are no problems.

Further, in the invention, it is preferable to add Ti and B for making the texture of ingot fine. The addition in amounts not more than 0.05 % of Ti and not more than 0.01 % of B is effective.

The aluminum alloys used in the invention are processed in a manner that, after solidified in the mold by continuous casting method or between a pair of cooled rolls or cooled plates, they are submitted to hot rolling, cold rolling and once or several times of intermediate annealing on the way, if necessary, and then submitted to cold rolling finally to the thickness of plate of 0.1 to 0.4 mm. For the intermediate annealing, it is desirable to heat and cool rapidly by using continuous annealing furnace in order to make the recrystallized particles fine and to improve the thermal softeningresistant characteristic, but no problems are caused particularly even if carried out by using usual batch furnace. Moreover, it is desirable to carry out the final cold rolling so that the surface reduction rate becomes more than 50 % for obtaining the uniformity of electrolytic roughening. Furthermore, the refining annealing may be carried out within a range not injuring the strength after the final cold rolling. Through this treatment, the appropriate ductility can be given and the fatigue strength can be enhanced further.

In following, the surface treatment methods of the aluminum alloy support for lithographic printing plate of the invention will be explained in detail.

As the graining methods in the invention, the electrochemical graining method wherein graining is made electrochemically in the electrolytic solution of hydrochloric acid or nitric acid and the mechanical graining methods such as wire brush graining method wherein the surface of aluminum is scratched with metallic wire, ball graining method wherein the surface of aluminum is grained with abrasive ball and abrasive material and brush graining method wherein the surface is grained with nylon brush and abrasive material can be used. Every graining method as described above can be used independently or in combination.

The aluminum thus finished the graining treatment is subjected to etching chemically with acid or alkali. When using acid as an etching agent, it takes too long time for the destruction of fine structures and the application of the invention is disadvantageous industrially, but this can be improved by the use of alkali as an etching agent.

As the alkaline agents usable suitably in the invention, caustic soda, sodium carbonate, sodium aluminate, sodium metalsilicate, sodium phosphate, potassium hydroxide, lithium hydroxide, etc. are mentioned and the preferable ranges of concentration and temperature are 1 to 50 % and 20° to 100° C., respectively. The conditions such that the dissolution amount of Al becomes 5 to 20 g/m$^3$ are preferable.

After the etching, acid pickling is carried out to remove the smut remaining on the surface. As the acids, nitric acid, sulfuric acid, phosphoric acid, chromic acid, fluoric acid, fluoroboric acid, etc. are used. In particular, as the preferable methods for the treatment to remove the smut after the electrochemical roughening treatment, there are a method to allow to contact with 15 to 65 wt. % sulfuric acid at a temperature of 50° to 90° C. as described in Japanese Unexamined Patent Publication No. Sho 33-12739 and a method to submit to alkali etching as described in Japanese Patent Publication No. Sho 48-28123.

The aluminum plate treated as above can be used as the support for lithographic printing plate, but it is preferable to give further the treatments such as treatment of forming anodic oxide film, chemical pretreatment, etc.

The anodic oxidation treatment can be carried out by the method adopted conventionally in this field. Concretely, when turning the power of direct or alternating current on to aluminum in aqueous or nonaqueous solution of sulfuric acid, phosphoric acid, chromic acid, oxalic acid, sulfamic acid, benzenesulfonic acid, etc. or a mixture combined two or more of these, anodic oxide film can be produced on the surface of aluminum support.

Although the treatment conditions of anodic oxidation can not be determined sweepingly since they change variously depending on the electrolytic solutions used, the ranges of concentration of electrolytic solution of 1 to 80 %, solution temperature of 5° to 70° C., current density of 0.5 to 60 A/dm$^2$, voltage of 1 to 100 V and time of electrolysis of 10 to 100 seconds are suitable generally.

Among these treatments of forming anodic oxide film, a method to oxidize anodically with high current density in sulfuric acid, which is used in the invention described in the specification of British Patent No. 1412768, and a method to oxidize anodically using phosphoric acid as an electrolytic bath, which is described in the specification of U.S. Patent No. 3511661, are preferable particularly.

The aluminum plate submitted to anodic oxidation may further be treated by the methods such as immersion etc. into an aqueous solution of alkali metal silicate, for example, sodium silicate as described in respective specification of U.S. Patent No. 2714066 and No. 3181461, or may be provided an undercoat layer thereon with hydrophilic cellulose (for example, carboxymethylcellulose etc.) containing water-soluble metallic salt (for example, zinc acetate etc.) as described in the specification of U.S. Patent 3860426.

Onto the support for lithographic printing plate of the invention, the photosensitive layer known hitherto as the photosensitive layer for PS plate can be provided to obtain photosensitive lithographic printing plate, and the lithographic printing plate obtained from this by the plate-making processing exhibits excellent properties.

As the compositions of photosensitive layer aforementioned, followings are included:

(1) Photosensitive layer consisting of diazo resin and binder

A condensation product of diphenylamine-p-diazonium salt with formaldehyde (so-called photosensitive diazo resen) disclosed in respective specifications of U.S. Pat. No. 2063631 and No. 1667415, which is a reaction product of diazonium salt with organic condensation agents containing reactive carbonyl group such as aldol and acetal, is used suitably. Other useful condensed diazo compounds are disclosed in respective publications of Japanese Patent Publication No. Sho 49-48001, No. Sho 49-45322 and No. Sho 49-45323 and others.

The photosensitive diazo compounds of these types can be obtained usually as a form of water-soluble inorganic salts and therefore can be coated from aqueous solutions. Or, these water-soluble diazo compounds are allowed to react with aromatic or aliphatic compounds having one or more phenolic hydroxyl groups, sulfonic acid groups or both of them by the method disclosed in Japanese Patent Publication No. Sho47-1167, and virtually water-insoluble photo-sensitive diazo resins being the reaction products thereby can also be used. Moreover, as described in Japanese Unexamined Patent Publication No. Sho 56-121031, they can be used as the reaction products with hexafluorophosphate or tetrafluoroborate. Besides, a diazo resin described in the specification of British Patent No. 1312925 is also preferable.

(2) Photosensitive layer consisting of o-quinonediazide compound

Particularly preferable o-quinonediazide compounds are onaphthoquinonediazide compounds, which are described in respective specifications of, for example, U.S. Pat. No. 2766118, No. 2767092, No. 2772972, No. 2859112, No. 2907665, No. 3046110, No. 3046111, No. 3046115, No. 3046118, No. 3046119, No. 3046120, No. 3046121, No. 3046122, No. 3046123, No. 3061430, No. 3102809 No. 3106465, No. 3635709 and No. 3647443 and in many publications. These can be used preferably.

(3) Photosensitive layer consisting of azide compound and binder (high-molecular compound)

Besides of compositions consisting of azide compounds and water-soluble or alkali-soluble high-molecular compounds described in respective specifications of for example, British Patent No.1235281 and No.1495861 and Japanese Unexamined Patent Publication No. Sho 51-32331 and No. Sho 51-36128, compositions consisting of polymers containing azide group and high-molecular compounds as the binders described in Japanese Unexamined Patent Publication No. Sho 50-5102, No. Sho 50-84302, No. sho 5084303 and No. Sho 53-12984 are included.

(4) Photosensitive layers other than foregoing

For example, polyester compounds as disclosed in Japanese Unexamined Patent Publication No. Sho 52-96696, polyvinylcinnamate-based resins described in respective specifications of British Pat. No. 112277, No. 1313309, No. 1341004, No. 1377747, etc., photopolymerization type photopolymer compositions described in respective specifications of U.S. Pat. No. 4072528 and No. 4072527 and others, positive type photosensitive layer containing polymer compounds having a repeating unit of orthocarboxylic acid ester decomposable with acid as shown in Japanese Unexamined Patent Publication No. Sho 56-17345, positive type photosensitive layer containing compounds having silyl ester group decomposable with acid as shown in Japanese Unexamined Patent Publication No.Sho 60-10247, positive type photosensitive layer containing compounds having silyl ether group decomposable with acid as shown in Japanese Unexamined Patent Publication No. Sho 60-37549 and No. Sho 60121446, positive type photosensitive layer containing compounds having o-nitrocarbinol ester group as shown in the specification of U.S. Pat. No. 3849137, negative type photosensitive layer containing photosensitive polyester shown in Japanese Unexamined Patent Publication No. Sho 55-40415, specification of U.S. Pat. No. 4412841 and Japanese Unexamined Patent Publication No. Sho 59-37539 as major components, and negative type photosensitive layer containing photopolymerizable compositions as shown in Japanese Unexamined Patent Publication No. Sho 59-46643 and No. Sho 59-53836 are included. The amount of photosensitive layer to be provided onto the support is within a range of about 0.1 to about 7 g/m$^2$, preferably 0.5 to 4 g/m$^2$.

After exposed the image to light, resin image is formed on PS plate by the treatments including the development according to usual method. For example, in the case of PS plate with photosensitive layer (1) above consisting of diazo resin and binder, the unexposed area of photosensitive layer is removed by development after the exposure of image to give the lithographic printing plate. Also, in the case of PS plate with photosensitive layer (2), by developing with aqueous solution of alkali after the exposure of image to light, the exposed area is removed to give the lithographic printing plate.

After the development treatment, the printing plate is subjected to post-treatments appropriately if desired.

Among the post-treatments, the most relevant treatment is burning for the reinforcement of image area. With respect to the burning, there are descriptions in, for example, Japanese Unexamined Patent Publication No. Sho 52-6205 and No. Sho 51-34001, Japanese Patent Publication No. Sho 55-28062 and No. Sho 57-3938, the specification of U.S. Pat. No.4191570, etc. Basically, the burning is to place the printing plate having finished the development in an atmosphere of a temperature of 150° to 350° C. and to sinter and harden the image area on the surface of plate.

In this case, it is preferable to supply an aqueous solution of, for example, boric acid or borate, anionic surfactants or compounds having other particular chemical formula of constitution onto the surface of plate before or after the burning.

By this procedure, various harmful effects due to the burning can be prevented. The temperature of burning relates to the burning effect together with the treatment time and, if setting the treatment time on 3 to 10 minutes or so, the burning can be conducted at a temperature of 180° to 300° C.

In following, the invention will be illustrated in more detail based on examples. Besides, % should read wt. % so long as the designation is not made elsewhere.

EXAMPLE 1

Aluminum alloys No. 1 through No.17 with the compositions shown in Table 1 were melted and casted and, after shaved both faces to obtain the ingots with a thickness of 500 mm and a length of 2000 mm, the soaking treatment was given to the ingots for 10 hours at 580° C. These were submitted to hot rolling at a temperature of 450° to 250° C. to make the thickness of plate 4.5 mm, then, submitted further to cold rolling to a thickness of plate of 2.0 mm and intermediate annealing was made for 4 hours at 360° C. After submitted to cold rolling further to a thickness of plate of 0.3 mm, refining annealing was made for 30 seconds at 300° C. through continuous annealing furnace to make up the aluminum alloy plates for lithographic printing plate.

TABLE 1

| No. | Mg, | Mn | Fe | Zr | V | Ni | Si | Cu | Ti | Al | Remarks |
|---|---|---|---|---|---|---|---|---|---|---|---|
| Present invention | | | | | | | | | | | |
| 1 | 0.81 | 0.00 | 0.30 | 0.05 | 0.01 | 0.00 | 0.10 | 0.01 | 0.01 | Balance | |
| 2 | 0.65 | 0.01 | 0.38 | 0.00 | 0.04 | 0.12 | 0.09 | " | " | " | |
| 3 | 0.73 | 0.00 | 0.22 | 0.00 | 0.09 | 0.00 | " | 0.02 | " | " | |
| 4 | 0.62 | 0.15 | 0.31 | 0.20 | 0.00 | 0.02 | 0.08 | " | 0.02 | " | |
| 5 | 0.15 | 0.82 | 0.11 | 0.02 | 0.20 | 0.00 | " | " | " | " | |
| 6 | 0.33 | 1.21 | 0.41 | 0.05 | 0.00 | 0.08 | 0.06 | 0.00 | " | " | |
| 7 | 0.28 | 1.33 | 0.27 | 0.03 | 0.10 | 0.05 | " | " | " | " | |
| Comparative example | | | | | | | | | | | |
| 8 | 0.05 | 0.01 | 0.25 | 0.13 | 0.01 | 0.01 | 0.09 | 0.01 | 0.01 | " | |
| 9 | 2.57 | 0.02 | 0.28 | 0.01 | 0.07 | 0.05 | " | " | " | " | |
| 10 | 0.82 | 2.55 | 0.18 | 0.02 | 0.11 | 0.00 | " | " | " | " | |
| 11 | 0.55 | 0.03 | 0.22 | 0.00 | 0.00 | 0.00 | 0.07 | " | " | " | |
| 12 | 0.41 | 0.02 | 0.44 | 0.38 | 0.00 | 0.01 | " | " | 0.02 | " | |
| 13 | 0.58 | 0.00 | 0.37 | 0.00 | 0.52 | 0.15 | " | 0.02 | " | " | |
| 14 | 0.77 | 0.21 | 0.29 | 0.20 | 0.03 | 0.17 | 0.05 | 0.01 | " | " | |
| 15 | 0.66 | 0.01 | 0.69 | 0.02 | 0.03 | 0.02 | 0.06 | " | " | " | |
| 16 | 0.28 | 1.20 | 0.33 | 0.14 | 0.02 | 0.00 | 0.25 | " | " | " | |
| 17 | 0.80 | 0.85 | 0.39 | 0.02 | 0.17 | 0.01 | 0.08 | 0.09 | " | " | |
| Conventional example | | | | | | | | | | | |
| 18 | 0.00 | 0.00 | 0.30 | 0.00 | 0.00 | 0.00 | 0.10 | 0.02 | 0.01 | " | JIS 1050 |
| 19 | 0.00 | 1.33 | 0.56 | 0.00 | 0.00 | 0.00 | 0.12 | 0.15 | " | " | JIS 3003 |

Next, after submitted mill-finished plates of aluminum alloys No.1 through No.17 and No.18 (plate thickness 0.30 mm, aluminum alloy plate according to JIS 1050-H18) and No.19 (plate thickness 0.30 mm, aluminum alloy plate according to JIS 3003-H18) to the graining treatment with rotating nylon brush in a suspension of Bamiston and water, they were etched using 20 % aqueous solution of caustic soda so that the amount of dissolution of aluminum becomes 5 g/m$^2$. Following sufficient washing with running water, they were submitted to acid pickling with 25 % aqueous solution of nitric acid and then washed with water to prepare the substrates. The substrates prepared in this way were electrolyzed in an electrolytic bath containing 1.5 % of nitric acid using alternating current with a current density of 20 A/dm$^2$. Successively, after made the surface clean by dipping for 3 minutes at 50° C. in 15 % aqueous solution of sulfuric acid, the oxide film amounting to 3 g/m$^2$ was provided at a bath temperature of 30° C. in an electrolytic solution having 20 % sulfuric acid as a major component.

Onto the samples thus made up, following photosensitive layer was provided so that the coating weight after drying becomes 2.5 g/m$^2$.

| | |
|---|---|
| Ester compound of naphthoquinone-1,2-diazide-5-sulfonyl chloride with pyrogallol and acetone resin (described in example of U.S. Pat. No. 3635709) | 0.75 g |
| Cresol novolak resin | 2.00 g |
| Oil blue #603 (made by Orient Chemical) | 0.04 g |
| Ethylene dichloride | 16 g |
| 2-Methoxyethylacetate | 12 g |

The photosensitive lithographic printing plates thus obtained were contacted closely with transparent positive and exposed to light for 30 seconds from a distance of 1 m with PS Light [one on the market from Fuji Photographic Film Co., Ltd. provided with 3 KW light source of Toshiba metal halide lump Model MU2000-20OL]. Then these were developed by dipping for about 1 minute in 5 % aqueous solution of Sodium Silicate, washed with water and dried to make samples No.1 through No. 19.

Of the samples No.1 through No.19 made in this way, the uniformity of hydrolytically etched rough surface, the staining of nonimage area, the fatigue strength and the thermal softening-resistant characteristic were tested. Results are shown in Table 2.

( Method of tests )

[1]Uniformity of hydrolytically etched rough surface

The state of surface was observed with scanning type electron microscope to evaluate the uniformity of pits and one being excellent was expressed by O, one being good by Δ and one being poor by X.

[2]Antistaining property of nonimage area

After printed a hundred thousand sheets of prints with offset press KOR, the staining of nonimage area was evaluated and one being excellent was expressed by O, one being good by Δ and one being poor by X.

[3]Fatigue strength

Test pieces with a width of 20 mm and a length of 100 mm were cut off from respective samples. With one end fixed to a jig, other end was bent upward by an angle of 30° and returned to the original position. Counting this procedure as one time, the times until breakdown were measured.

[4]Thermal softening-resistant characteristic

Sample was heated for 7 minutes at 300° C. in Burning Processor 1300 [burning processor with a heat source of 12 KW made by Fuji Photographic Film Co., Ltd.]. After cooling, test pieces corresponding to JIS No.5 were made and tensile test was carried out to measure the tensile strength and 0.2 % yield strength value. In addition, the fatigue strength was measured by similar method of [3]. For practical purpose, it is preferable that these characteristics hardly vary compared with those before heating for burning.

TABLE 2

| No. | Uniformity of electrolytically etched rough surface | Anti-staining property of nonimage area | Tensile Strength (Kg/mm$^2$) Before heating for burning | Tensile Strength (Kg/mm$^2$) After heating for burning | 0.2% Yield strength (Kg/mm$^2$) Before heating for burning | 0.2% Yield strength (Kg/mm$^2$) After heating for burning | Fatigue strength ($10^2$ times) Before heating for burning | Fatigue strength ($10^2$ times) After heating for burning | Remarks |
|---|---|---|---|---|---|---|---|---|---|
| Present invention | | | | | | | | | |
| 1 | | | 22.5 | 21.2 | 20.5 | 19.1 | 710 | 820 | |
| 2 | | | 23.7 | 21.8 | 21.2 | 19.0 | 725 | 805 | |
| 3 | Δ | | 22.9 | 20.8 | 20.9 | 19.2 | 740 | 865 | |
| 4 | Δ | Δ | 22.8 | 21.9 | 21.5 | 20.4 | 720 | 800 | |
| 5 | | Δ | 23.1 | 21.5 | 20.4 | 19.9 | 735 | 855 | |
| 6 | Δ | Δ | 23.2 | 21.1 | 20.7 | 19.5 | 715 | 840 | |
| 7 | Δ | | 24.2 | 22.5 | 21.5 | 20.8 | 750 | 905 | |
| Comparative example | | | | | | | | | |
| 8 | | Δ | 14.4 | 12.1 | 11.8 | 10.0 | 315 | 325 | |
| 9 | Δ | X | 23.5 | 21.1 | 21.2 | 19.2 | 820 | 910 | |
| 10 | X | X | 25.2 | 22.9 | 23.1 | 22.0 | 950 | 990 | |
| 11 | | Δ | 20.0 | 17.0 | 14.2 | 12.5 | 610 | 590 | |
| 12 | X | X | 22.4 | 21.0 | 20.7 | 19.9 | 705 | 720 | |
| 13 | X | Δ | 22.1 | 20.9 | 20.7 | 20.0 | 680 | 760 | |
| 14 | X | X | 22.5 | 21.0 | 21.5 | 20.1 | 705 | 710 | |
| 15 | X | X | 22.7 | 20.8 | 20.9 | 19.7 | 710 | 720 | |
| 16 | Δ | X | 22.1 | 20.9 | 20.7 | 19.9 | 695 | 725 | |
| 17 | X | X | 22.2 | 20.8 | 20.7 | 20.0 | 720 | 730 | |
| Conventional example | | | | | | | | | |
| 18 | Δ | Δ | 16.2 | 8.5 | 14.5 | 5.4 | 270 | 300 | JIS1050-H18 |
| 19 | X | X | 22.2 | 18.1 | 19.5 | 16.2 | 580 | 620 | JIS3003-H18 |

As evident from Table 2, with the aluminum alloy plates No.1 through No.7 of the invention, both the uniformity of electrolytically etched rough surface and the antistaining property of nonimage area are more than equal to those of conventional JIS 1050-H18 and the tensile strength and fatigue strength (before heating) are equal to those of JIS 3003-H18. Further, with respect to the thermal softening resistance, the tensile strength, 0.2 % yield strength and fatigue strength after heating for burning are all superior to those of JIS 3003-H18 suggesting extremely high stability to heat.

On the contrary, with No.8 low in the amount of Mg, the tensile strength and fatigue strength are inferior and, with alloy plate No.11 without Zr, V or Ni, the thermal softening resistance is poor. With No.9, No.10 and No.12 through No.17 with more Mg, Mn, Zr, V, Ni, Si or Cu, either the uniformity of electrolytically etched rough surface or the antistaining property of nonimage area is poor.

As described above, since the aluminum alloy supports for lithographic printing plate of the invention are excellent in all points of the uniformity of electrolytically etched rough surface, antistaining property of nonimage area, fatigue strength and thermal softening characteristic, high-quality lithographic printing plates having improved printing tolerance and being correspondent to the rise in printing speed can be obtained.

What is claimed is:

1. A photosensitive lithographic printing plate, comprising:

an aluminum alloy support having a photosensitive layer thereon, said aluminum alloy support comprising 0.05–0.5 wt.% of Fe, 0.1–0.9 wt.% of Mg, 0.01–0.3 wt.% of V and/or Ni, not more than 0.2 wt.% of Si, not more than 0.05 wt.% of Cu with the remainder being aluminum and the inevitable impurities.

2. The photosensitive lithographic printing plate of claim 1, wherein the alloying constituency of said aluminum support further comprises from 0.01–0.3 wt.% of Zr.

3. The photosensitive lithographic printing plate of claim 1, wherein the alloying constituency of said aluminum alloy support further comprises from 0.05–2 wt.% of Mn.

4. The photosensitive lithographic printing plate of claim 1, wherein the alloying constituency of said aluminum alloy support further comprises from 0.05–2 wt.% of Mn and 0.01–0.3 wt.% of Zr.

5. The photosensitive lithographic printing plate of claim 1, wherein said photosensitive layer is applied to said support in an amount within the range of about 0.1 to about 7 $g/m^2$.

6. The photosensitive lithographic printing plate of claim 5, wherein the range of said applied amount of photosensitive layer ranges from 0.5–4 $g/m^2$.

7. The photosensitive lithographic printing plate of claim 1, wherein said photosensitive layer consists of a diazo resin and a binder, an o-quinonediazide compound or an azide compound with a binder.

8. The photosensitive lithographic printing plate of claim 1, wherein said photosensitive layer is formed from a polyester compound, a polyvinylcinnamate-based resin, a photopolymerization-type photopolymer, a positive-type photosensitive material containing polymer compounds having repeating orthocarboxylic acid ester units decomposable with an acid, a positive-type photosensitive material containing compounds having silyl ester groups which are decomposable with an acid, a positive-type photosensitive material containing compounds having silyl ether groups decomposable with an acid, or a positive-type photosensitive material containing compounds having an o-nitrocarbinol ester group.

9. The photosensitive lithographic printing plate of claim 1, wherein said photosensitive layer is formed from a negative-type photosensitive material containing a polyester, or a negative-type photosensitive material containing photopolymerizable compositions.

* * * * *